US005902360A

United States Patent [19]

Linzell

[11] Patent Number: 5,902,360

[45] Date of Patent: May 11, 1999

[54] SURFACE-MODIFYING TOOLS

[75] Inventor: Geoffrey Robert Linzell, Hatfield, United Kingdom

[73] Assignee: Ball Burnishing Machine Tools Limited, Hatfield, United Kingdom

[21] Appl. No.: 08/765,559

[22] PCT Filed: Jul. 10, 1995

[86] PCT No.: PCT/GB95/01614

§ 371 Date: Jan. 9, 1997

§ 102(e) Date: Jan. 9, 1997

[87] PCT Pub. No.: WO96/01721

PCT Pub. Date: Jan. 25, 1996

[30] Foreign Application Priority Data

Jul. 12, 1994 [GB] United Kingdom ..... 9414066

[51] Int. Cl.[6] ..... B24D 11/00

[52] U.S. Cl. ..... 51/295; 51/299; 51/293; 428/447

[58] Field of Search ..... 51/295, 299, 293; 428/290, 447; 524/267

[56] References Cited

U.S. PATENT DOCUMENTS 4,963,432 10/1990 Fugginin et al. ..... 428/290

FOREIGN PATENT DOCUMENTS 0 392 316 10/1990 European Pat. Off. ..... C09G 1/00
1106780 3/1968 United Kingdom ..... B24B 35/00
WO-93/24272 9/1993 WIPO ..... B24B 31/116

OTHER PUBLICATIONS

Patent Abstracts of Japan, JP57162768 (Jun. 10, 1982) Abstract.

*Primary Examiner*—Deborah Jones
*Attorney, Agent, or Firm*—Synnestvedt & Lechner

[57] ABSTRACT

In a method for removing metal from the surface of a workpiece by continuously rubbing the surface with a tool in a friction-inducing manner and in the presence of a friction-enhancing agent (an anti-lubricant) and in which a thin layer of the friction-enhancer must be available at the tool surface, there is provided a tool which carries the friction-enhancing agent in the form of a composition of an abrasive and a rubbery solid siloxane reaction product admixed with a liquid, mobile, anti-lubricant siloxane stably dispersed therewithin, and the use of the tool to excoriate and condition the surface by removing therefrom the oxide film thereon and leaving its place a siloxane film, and a conditioned metal surface having siloxane molecules each individually bonded directly to the metal over a relatively large area of the surface to provide a relatively uniform siloxane layer.

20 Claims, No Drawings

SURFACE-MODIFYING TOOLS

This invention is concerned with surface-modifying tools. More specifically, it relates to abrasive tools for modifying the surface of a metal part so as to shape that part or to condition that surface, and it concerns the use of these tools to do these things. It also relates to metal parts thus shaped or conditioned—and in addition it pertains to conditioned-surface metal parts prepared in related but slightly different ways.

In the Specification of our International Patent Application WO 93/24,272 (=GB No: 2,267,242A: P1285) there is described and claimed a method of removing metal from the surface of a metal workpiece by continuously rubbing that surface with a tool in a friction-inducing manner and in the presence of a friction-enhancing agent (an anti-lubricant) in a quantity and in a form such that actual friction enhancement occurs. It is explained how, in the case of surface-shaping rubbing tools such as grinding wheels, some extra workpiece material that is in frictional contact with the tool is sheared from the surface as a result of the increase in kinematic coupling as the friction between tool and workpiece rises, and hence the abrasive tool efficiency is improved.

Operating experience has shown there are many uses for the above-mentioned friction-enhanced shaping of metals, and in particular for those varieties of shaping methods using abrasive media. Furthermore, experience has shown that it is essential that an appropriately thin layer of the friction-enhancer always be available at the surface of the tool, where it makes contact with the workpiece, and is actually carried between the rubbing surfaces as the tool rubs against the workpiece. In the above-mentioned PCT Specification several ways of applying the preferred friction-enhancers, which are siloxanes, are described. In particular, one commercially-attractive method is described involving impregnating and reacting a layer of siloxane onto the vitreous structure within a porous grinding wheel. This system works particularly well when sufficient new wheel surface is created (due principally to re-dressing, or to a lesser extent, to wear) to allow fresh siloxane to reach the surface, as is the case with frequently- or continuously-dressed wheels. However, in some cases the wheel surface lasts longer in the presence of a siloxane, and as a consequence under some operating conditions the supply of siloxane to the surface can after some time become minimal, and in extreme cases inadequate for the purpose of maintaining the sought-after improvement of cutting for the life of the wheel.

Moreover, experience has shown that after prolonged operation under some conditions the siloxane impregnated into the wheel suffers slow degradation near the contact zone around the rim of the wheel. It is thought this is due to the high temperatures near the contact zone, as well perhaps as to the long term exposure of the wheel to the fluids used as the coolant.

The present invention in one of its several related aspects suggests a solution to these two problems; it proposes a novel type of friction-enhancing-agent-carrying abrasive rubbing tool (and its use in a method like that of the aforementioned Specification) in which the friction-enhancing agent is carried by the tool in the form of a composition of an abrasive and a rubbery solid siloxane reaction product admixed with a more liquid, mobile siloxane (that itself has the necessary anti-lubricant, friction-enhancing properties) immobilised—stably dispersed—within the reaction product. For instance, the present invention proposes that the tool be impregnated with a siloxane reaction-product curable fluid that contains within itself a siloxane with friction-enhancing anti-lubricant properties, this fluid being cured within the tool into a rubber-like material that adheres to the structure of the tool and that slowly and evenly releases the anti-lubricant siloxane therein as the tool is used. Ideally, this reaction-product material is evenly distributed throughout the porous tool structure, and in fact forms a secondary structure therein. The free anti-lubricant siloxane contained therein is able slowly to escape under the mechanical forces of the tool spinning (or reciprocating to and fro, or whatever is appropriate). Indeed, in the case of grinding wheels or coated abrasive discs the free friction-enhancing siloxane is probably released some distance away from the contact zone, and thus away from where it is thought it might be damaged by high temperature or coolant fluids, and migrates to the rubbing surface where it is carried into the contact zone to maintain a fresh supply of new, undamaged, friction-enhancing siloxane.

In another related aspect, however, the invention concerns the use of tools (rather like those just described) not to abrade the metal part's surface in some significant manner (which would result in the tool actually cutting down into the underlying metal, so shaping the metal part) but instead merely to excoriate the metal part—to remove by rubbing abrasion a very thin surface layer or skin, and specifically to remove little more than the oxide film inevitably formed on the surface, leaving the surface clean, bare metal. Such excoriating, rather than shaping, tools are the result of the work leading to the shaping-tool invention; while doing this it was discovered that during relatively light abrasion where the metal being shaped was protected from exposure to further oxygen, and was allowed to remain covered with a layer or coating of siloxane, the metal was imbued with certain surprising properties.

Firstly, it was found that the coated metal appeared to have significantly-improved anti-corrosion properties—and, specifically, resisted atmospheric corrosion (reaction with atmospheric oxygen). Iron, for example, either didn't go rusty, or showed only a minimal rusting even after a very long time.

Secondly, it was found that the coated metal seemed to provide a much better base for a subsequent layer/coating of adhesive or paint. Standard tests showed a very considerable increase in the tenacity of an adhesive coating applied to a siloxane-coated steel plate as compared with one applied to an uncoated plate.

This lead to a second novel type of tool, and a second major aspect of the invention, namely a mildly—abrasive rubbing tool (and its use in a method of providing a metal part with a specially-conditioned surface) in which a siloxane, chosen for its ability to imbue the surface with some desired special property, is carried by the tool in the form of a composition of a fine abrasive and a rubbery-solid siloxane reaction product admixed with a more liquid, mobile siloxane (that itself has the appropriate property-imparting nature) immobilised—stably dispersed—within the reaction product. The chosen siloxane may, for instance, be either a friction-enhancing agent or a lubricating agent, it may be hydrophilic or hydrophobic, and it may show enhanced compatibility or reactivity with certain types of chemicals (and the chemical might be some biological material so that the conditioned surface displayed some biochemical activity).

Further work carried out with this type of excoriating tool revealed a number of interesting features. For example, the criteria for conditioning being somewhat different to those involved in shaping, it was not actually necessary to use a siloxane in the form of a rubbery siloxane reaction product composition; instead, it was possible to prepare very satisfactory conditioned metal surfaces by carrying out the excoriation with practically any mild abrasive and in the presence of any appropriate siloxane.

Thus, in yet another related aspect the invention concerns a method of conditioning a metal part (so that it carries bonded to its surface a siloxane layer) by first excoriating the metal surface in the presence of a siloxane and under oxygen-excluding conditions, to clean off the oxide film therefrom, and then further rubbing it in the presence of a siloxane to form on the clean surface the desired layer of individual siloxane molecules bonded directly thereto.

And the thus-formed conditioned surfaces are in fact both novel and inventive—and useful—in themselves, and accordingly in a still further related aspect the invention pertains to a metal part with a conditioned metal surface having siloxane molecules each individually bonded directly to the metal over a relatively large area of the surface to provide a relatively uniform siloxane layer.

These various aspects of the invention will now be discussed in more detail.

The tools

In a first aspect the invention provides an abrading tool which comprises:

a substrate on the surface of which, and optionally in the body of which, is carried an abrasive composition itself comprising
an abrasive admixed with
a rubbery composition
which is the reaction product of a reactive polyfunctional siloxane co-polymerized with itself or with one or more other reactive polyfunctional siloxane to form a rubbery-solid material, this reaction product being admixed with a liquid, mobile siloxane which is stably dispersed therewithin.

The tools of the invention may notionally be divided into those intended for shaping an object—for being applied to the object's surface to wear away significant quantities of the object material—and those intended for excoriation (and conditioning)—for skimming off a thin skin (the very surface layers) of the object to reveal the clean material underneath (where the object is a metal such as iron or an alloy thereof like steel the surface stripped off is usually merely the oxide layer, revealing clean, bare, metal). This division will commonly be on the basis of the hardness and stiffness of the tool substrate, of the coarseness of the abrasive, and of the anti-lubricant or other nature of the mobile siloxane; hard, stiff, coarse tools will abrade away significant amounts, and so will shape, whereas soft, flexible, fine tools (regardless of the siloxane) will merely excoriate. And naturally there will be some overlap: some tools may be usable for either purpose, it depending on quite how, and for how long, they are utilised.

Types of tool and metal-removal i) Shaping tools

The invention's shaping tools can be applied to almost any kind of material-removing and—shaping process provided that there be used a technique involving rubbing friction to be enhanced by the presence of the anti-lubricant siloxane, and so there may be used almost any kind of tool on almost any kind of workpiece. Thus, the tool can be applied to conventional machining (as done using a lathe, or a milling machine, or a saw, provided the tool itself rubs), and—and especially—to any of the various forms of abrading processes.

All the above-mentioned processes used in the shaping of a metal workpiece depend on the removal of many small slivers from its surface on each successive rubbing contact (the rubbing friction causes welding between the tool and the surface, and the material under the rubbing contacts is then sheared off by the continuing tool motion). The size of each sliver is small, estimated to be of the order of 0.001 $m^3$ for soft materials and less than this for hard materials. In the case of a multi-contact tool system like a wire brush (perhaps with polished terminating balls anchored to the end of each wire), or "flex hone" (a wire brush with abrasive balls anchored to the ends of the wires) or a grinding wheel, many thousands of contacts can be made and slivers removed within a second to give a satisfactory metal removal rate.

The tool substrate can be of many different kinds, ranging from the extremely hard material of a conventional grinding wheel (for shaping) down to the softest of tissue papers (for excoriating). Varieties of tool are now discussed to illustrate this.

A grinding wheel is an abrasive tool, along with honing stones, lapping stones and pastes, electroplated-diamond—and—cubic-boron nitride reamers, linishing belts, discs, de-burring mediums, and many others. All the abrasive tools depend on rubbing to create the essential tool/workpiece interface motion between randomly orientated small grains of hard material. This brings the individual cutting tools (grains) into contact with the workpiece surface to give them the opportunity to cut. Only those cutters with favourably positioned cutting edges and surfaces will actually cut (and in most abrasive systems this is less than 50%); those with unfavourably-positioned cutting edges and surfaces simply cause friction heat due to ploughing (plastic deformation) and rubbing. The tool of the invention will improve the efficiency of all the above-mentioned shaping methods because it uses the otherwise-wasted heat energy to cause the microwelding that results in additional material removal.

ii) Excoriating, conditioning tools

In its excoriating, conditioning guise the tool of the invention may be of the type of many of the conventional abrading, de-burring and finishing tools utilised in industry save for its employment of fine, or mild abrasives, such as those tools using abrasive-loaded nylon filaments, non-woven abrasive materials, coated abrasive belts, flap wheels, and cloth buffs.

One particularly interesting variety of excoriating, conditioning tool is that which is little more than a sheet of paper coated or impregnated with the abrasive/rubbery-siloxane composition; this type can range from flimsy absorbent papers (almost like tissue paper) to rather stiffer, more substantial papers (like those referred to as "sandpaper" or "glasspaper").

In the case of flexible tools based upon a fabric or paper substrate the rubbery siloxane composition can be used to bond the abrasive onto, and into, the substrate. Indeed, if treated with a composition containing a fine abrasive—or, and preferably, if dusted with abrasive and then given a coating of the rubbery material to form the desired abrasive composition in situ on the surface—a simple sheet of paper can become a useful excoriation tool for surface conditioning, similar to fine sandpaper or emery paper. If the substrate is absorbent and the siloxane composition is applied thereto in its raw, unreacted-component form so that it soaks into the material and there cures to the desired rubbery consistency, this can be used to bind the abrasive securely to (and into) the surface. Moreover, applying the siloxane composition in that raw, liquid form to a porous substrate such as paper or cloth permits the making use of the adhesive nature of the composition to effect the bonding of the substrate to a firmer support as the composition cures to its desired rubbery form.

In the case where the absorbent material substrate is a sheet of paper the abrasive tends to concentrate at the surface to which it is applied, while some uncured fluid soaks into and through the paper, so that there is formed a "double-sided" paper the first side of which carries abrasive, and so has a relatively substantial abrasive action, and the second of which has only a very mild abrasive, or polishing/conditioning, effect due mainly to the paper fibres. Thus, by first rubbing with the coated abrasive side and then turning the paper over and just using the impregnated surface, an exceptionally fine conditioned surface finish can be obtained on most metals.

Tools made from treated paper can use either a relatively light quality paper or—for a superior effect—a purposely absorbent paper—a Kraft paper, or one of those types such as those marketed under the trade name ABSORBEX (manufactured by Laminating Papers Ltd. Kanavaranta 1, PO Box 309, Helsinki, Finland). These papers are designed to absorb impregnants, and will swell and hold considerable amounts of cured or uncured composition. Moreover, as the paper swells so the pores at its surface open and allow some of the (fine) abrasive to be drawn into the structure (though even so most—and especially the coarser components—remains close to or at the surface). The effectiveness of this combination as an abrasive tool is ultimately determined by the stiffness of the backing provided. As described hereinafter with reference to the Examples, one of the abrasives used in preliminary tests was white 320 grit fused alumina; this provided a good surface polishing action well suited to excoriating a mild steel surface.

Many commercially-available papers are in fact designed for laminating, and it is possible, by using many layers of a lightweight paper, to build a laminated construct of individually-impregnated layers that forms an altogether heavier and more substantial structure, suited for use in abrasive tools like sticks, wheels, rollers or even thick flexible belts (and the rubbery siloxane composition also serves to bond the layers together). Some fibrous or thin metal mechanical backing can additionally be incorporated in such a structure.

Another interesting and useful material for impregnating with a rubbery siloxane composition and use in the invention is cloth, particularly one of the many varieties of non-woven cloth. A typical commercially-available instance of this sort of cloth comprises a blend of 80% polypropylene/20% cotton—for example, those sold as grade HWC 35 or 50 by Bonded Fibre Fabric Ltd. of Bath Road, Bridgwater, Somerset, UK. The surface of many of these materials is indented, and, while the very fine components of the abrasive in the unreacted liquid composition soak down into the material, the coarser components accumulate in and fill the indentations. Thus, a small amount of relatively coarse abrasive can be added to and mixed with a larger amount of fine abrasive, the former's particle size being chosen so the depth of the indentations in the treated material surface is able to carry the coarse abrasive without it protruding awkwardly above the fine. The blend can be selected according to function, but the combination makes a more aggressive abrasive when using a hard backing (if a soft backing is used the larger abrasive has little effect). Thus, by varying the backing stiffness or rigidity it becomes possible to adjust the effective abrasive nature of the tool, this feature hitherto only being possible by changing the grain size (which normally means changing the tool itself).

One other, and quite different, possibility for the tool is to make the entire tool out of the rubbery composition—in other words, the substrate is the rubbery siloxane composition, fashioned into a rubber-like body that itself actually constitutes a tool. For example, a mixture containing either one or more grades of abrasive can be moulded into a shape or into a recess in a tool post or holder.

iii) Making the tools

In the above discussion of the tools themselves there has been made some references to how the abrasive rubbery composition is actually applied to the substrate. For the most part, the composition can be prepared as a liquid mixture of all the ingredients—that is, the abrasive, the mobile siloxane, and the reactive siloxane components of the desired rubbery product—and then applied to the substrate as it is curing. Sometimes, however, it may be convenient to add the abrasive component in situ rather than beforehand. For example, when making a shaping grinding-wheel tool it may actually be necessary first to load the wheel with the fine abrasive—vibrating it in—and then to soak in the liquid siloxane composition, which cures in place to give the desired abrasive composition (and a similar technique can be used when the substrate is a flexible cloth or paper).

Moreover, where the rubbery composition is one which is desirably cured with a catalyst, then, to extend the working life of the various components, it may be preferred not to mix the catalyst with the components and then apply the mixture to the substrate but instead to soak the catalyst onto or into the substrate and then apply the remainder of the composition thereto.

The abrasive composition a) The abrasive

Whether for shaping or for excoriating/conditioning, the tools of the invention have on (or in) their substrate an abrasive composition itself comprising an abrasive admixed with a rubbery siloxane composition. The abrasive may be any of those materials used, or suggested for use, for that purpose, and may range from extremely coarse (for shaping) to extremely fine (excoriating/conditioning) materials. Typical such materials are alumina, silicon carbide, cubic boron nitride (CBN), and diamond, each available in grit sizes from coarse—size 20 (1,000 micrometer)—to fine—size 1,200 (4 micrometer). Some comments about the abrasive and its use and effect now follow.

The rubber-like solid forms a secondary structure within or at the surface of the primary structure provided by the tool substrate; this secondary structure binds in and retains the added abrasive—which will most usually be fairly fine, typically a 320 grit (with particles sized at 30 microns and less)—but which can be quite coarse, typically a grade 120 or less. Where the tool itself is an abrasive structure, such as a grinding wheel or disc, the rubbery composition's abrasive is thus a secondary abrasive (and is occasionally referred to as such hereinafter for convenience). Such a secondary abrasive is added deliberately, but may also spontaneously appear as the tool actually wears down the surface of the workpiece, being a mixture of microscopic particles derived both from the workpiece surface and from the tool itself. A deliberately-added secondary abrasive migrates into the rubbing zone as the tool is used—thus, as a grinding wheel spins—to create more rubbing contacts. This is particularly advantageous when machining hard materials that do not plasticly deform when in rubbing contact with the tool, for the fine secondary abrasive will penetrate the rubbing interface with the friction-enhancer, and will then create many extra microscopic rubbing sites when trapped and packed together between the hard main abrasive and the hard workpiece surface. The friction of each of these sites will be individually enhanced by the friction-enhancer, and this rapidly builds up to give the required kinematic coupling needed to shear off hard surface material. It is important to note that the observed useful increase in metal removal is achieved only when testing against hard steel; no significant increase is observed when abrading a plasticly-deformable mild steel, for there the basic tool's effect is already as great as can be expected.

And perhaps surprisingly, the use according to the invention of one of the defined rubbery solid siloxane compositions can be of benefit even when applied to tools with what might be thought of as non-porous structures (a sanding disk, for example); by coating the surface of the tool so the stored siloxanes and abrasive are retained within the roughness of the surface.

Adding the abrasive might seem unnecessary when the tool is a shaping tool which is already highly abrasive, as is the case with a grinding wheel or disc, rather than an excoriating, conditioning tool, but in fact that is not the case. The abrasive has an unsuspected benefit; it seems that the rubbery compositions used in the invention may, under unfavourable conditions, actually act as lubricants when trapped between large low pressure rubbing areas because their large molecules can maintain tool/workpiece interface separation under light mechanical compression. This is detrimental to the shaping method of the invention, which seeks to promote friction between the surfaces, and it is at least partially to combat this possibility that the abrasive is added to the composition, for the particles of the former tend to bridge the separation gap created by the large molecule reaction products in the latter, and thus prevent lubrication occurring (and for this to be most effective it is desirable that the rubbery composition be chemically weak, and thus relatively easily degraded to release the abrasive particles).

As intimated above it is thought that the added (secondary) abrasive mainly cuts not by conventional shearing, as an ordinary abrasive does, but instead by frictional shear. To explain this belief it is important to distinguish between the behaviour of a fixed (primary) abrasive (as on a grinding wheel) and that of a "free" one (as is effectively the case with the added, secondary, abrasive retained in a rubbery matrix). The attitude (orientation) of the immovable abrasive grains in a tool like a grinding wheel are fixed in relation to the work surface, and cannot change, and it is this rigidity that enables a grain, when one of its cutting edges is favorably oriented, to shear/cut/chisel material from the surface, like butter scraped up with a firmly-held knife. By contrast, a "free" grain will under the applied forces adjust its orientation to take up positions of greatest stability, and these occur when flat slides against flat—when a flat grain surface slides against the flat workpiece surface—like the situation in which the knife is held so loosely that it rotates in the hand, and merely wipes across the surface. Hence, a secondary abrasive grain—a grain that is basically free, albeit constrained or retained within the rubbery matrix—with many flats will be most stable when it is trapped between the tool and workpiece with a flat in contact with each—in other words, when it has achieved the maximum possible contact area. This is not only the most stable condition but it is also the best rubbing condition. Thus, it is believed the free abrasive only acts as a rubbing abrasive and does little or no conventional shear cutting. However, this rubbing is just what is wanted; when rubbing friction is increased, at some point the frictional coupling will be so great that kinematic coupling occurs and shears surface material off. It is this that causes the improvement in metal removal when utilising a secondary abrasive.

b) The rubbery siloxane composition

The rubbery composition used in the invention's tools is the reaction product of a reactive siloxane co-polymerized with itself or with one or more other reactive siloxane to form a rubbery solid material.

This rubbery solid is preferably fairly soft—and may even be more like a gel than a true solid—so that: it can deform and release the stored mobile siloxane; it will slowly creep and break up under the prolonged influence of tool-operating forces to release the abrasive; and it is dragged into and so penetrates the tool/workpiece interface. Ensuring that it is fully reacted gives it good long term stability and excellent shelf life. The less reacted and more gel-like materials—although these tend to dry out over long periods of time, and so have a more limited life than the fully-cured rubbers, they are easier to use as carriers of some of the more reactive and sensitive mobile siloxanes (the methyl-hydrogen ones, for instance), and so may have definite advantages—will behave almost like a very thick viscous fluid with a high surface tension able to wet onto and stick to a surface but only slowly to flow under the operating forces of the tool. A gel-like rubbery material will, because of its high surface tension, resist static creep, but it may creep under certain dynamic conditions—such as, for instance high "G" forces encountered in handling or transportation. It will effectively retain the additional siloxane without serious risk of this leaching out, both before and after drying (though in the latter case its contained mobile siloxane can still escape under the influence of the mechanical forces of the tool). Gel compositions are best suited for application to the surface of a tool substrate; because of their immediate relatively high viscosity they are not suited to being absorbed into the body of the substrate.

Compositions having the required properties are now described.

The rubbery compositions used in this invention contain the cross-linked reaction product of a polyfunctional siloxane with either itself (perhaps with the assistance of a cross-linking agent such as a reactive silane) or with at least one other, different, polyfunctional siloxane (so that the composition is made up of at least two different monomeric units each of which is itself a polyfunctional siloxane polymer; the product is thus a co-polymer). These siloxane materials are polyfunctional in that each contains at least two, and preferably at least three, functional groups (which may be the same or different) by which it can react with, and so attach itself to, the other to form a loose three-dimensional matrix capable of holding the relatively mobile silicone therewithin. Moreover, they are siloxanes—that is, they are themselves silicone polymers made up of many units derived from moieties of the type

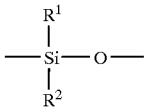

wherein $R^1$ is an alkyl group, and $R^2$ is the same or a different alkyl group (the preferred alkyl group $R^1$ and $R^2$ is the methyl group); these siloxane starting materials are themselves conveniently prepared by reacting corresponding compounds wherein some of the R groups are hydrogen with the donors of the required functional groups. The more useful starting siloxanes seem to be those of relatively limited reactivity, and those of relatively low molecular weight, and thus relatively short chain length (the number of the above moieties in each unit is conveniently, but not necessarily, from below 10 to above 300.

As to the functional groups, these can, within reason, be almost any set of groups capable of reacting one with another to form the desired polymeric product. One suitable pair of such groups is amine and dicarboxylic anhydride,

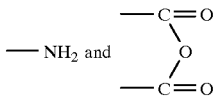

which react together, two amine to one anhydride, to form amide linkages

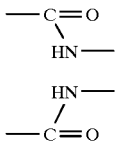

many of which will result in several molecules being cross-linked eventually to form a matrix having a complex dimensional structure (this sort of reaction product is particularly useful in forming gel-type compositions).

Depending upon the polyfunctionality of the monomers chosen, the reaction product may be a linear polymer and yet, by virtue of the shape and 3D nature of the monomers, have a 2D or even 3D shape of its own, or it may be a 2D macromolecule, rather like a net, or a 3D macromolecule like a sponge. Moreover, even where the product is mostly sheet—or net-like, it may be interlinked so as to result in a loose three-dimensional structure. The problem is that determining the physical shape and structure of giant molecules such as these is extremely difficult, and at this time it is not easy to provide any information thereon except educated guesswork.

As will be apparent, the possible polyfunctional siloxanes may have a wide variety of forms, but are preferably polydimethyl siloxanes. Most preferably they are of relatively low molecular weight (and thus have a relatively short chain length). Typical actual materials are the following:

Masil 28 This is a "hydrosilicone" supplied by Mazer (PPG) Chemicals. It is believed to be a polydimethylsiloxane (with around 100–110 dimethylsiloxane monomer units) typically containing four active acid anhydride groups. It has a molecular weight of about 8,000, and a viscosity of around 130 c/s, and is said to be disclosed in PPG U.S. Pat. No: 4,876,152.

DC 109 Supplied by Dow Corning, this is thought to be a hydroxy-terminated polydimethyl siloxane (estimated chain length 600–650, molecular weight 47,000 and viscosity 4000 c/s).

DC 1107 Supplied by Dow Corning, this is a polymethylhydrogen siloxane (estimated chain length 30–35, molecular weight 2,600, viscosity 30 c/s).

Rhodorsil Oil 21637 Another amino functional material from Rhone-Poulenc, believed to be a diamine polydimethylsiloxane (chain length estimated at 160–180, molecular weight 13,500, viscosity 300 c/s; amine content 4,200 ppm).

Rhodorsil 48V50 to 1,000,000 A series of materials from Rhone-Poulenc. They are thought to be hydroxy-terminated polydimethylsiloxanes (estimated minimum chain length 50, molecular weight 3,800, viscosity 50 c/s).

Silane A-1120 N(beta-aminoethyl)-gamma-aminopropyltrimethoxysilane. A diamino-functional silane from OSi Specialities.

Silane Y-11343 This is an organofunctional silane crosslinker and adhesion promoter supplied by OSi Specialities, with a viscosity of 70–100 cSt and a total amine content equivalent to 2.7–3.0 moles N/kg.

In one case the cross-linked rubber-like reaction product is formed by first mixing the reactants with the free siloxanes before a final catalyst is added. Immediately after applying the catalyst the mixture is—should be formulated to be—a fairly low viscosity liquid of between 200 c/s and 600 c/s; as such it can be applied to a surface where normally it will cure at room temperature trapping the free siloxanes securely within its structure. The cure time varies from less than four hours to as long as several days, depending on the formulation and the conditions.

The liquid siloxane compositions developed will, when catalysed, cure at room temperature to the desired rubbery form with good adhesion onto most dry, clean, degreased surfaces—in particular to the impervious smooth surfaces of many plastics, vitreous materials, ceramics, metals or the cured resins often used to secure the abrasive in coated abrasive systems. When applied to permeable surfaces like paper or woven fabric or a non-woven cloth the liquid composition will absorb or soak into the material before curing, which causes non-woven cloth to swell noticeably. When applied to an open porous body like a grinding wheel it will soak in and penetrate deep into the porous tool, and bond to the interior surfaces of the structure as it cures.

It is important to note that the cross-linking or "vulcanization" of the siloxane reagents forming the uncured liquid composition can take place in the presence of the free siloxanes even after absorption of the liquid composition either into another material like paper or into the confined spaces within the porous structure of a tool like a grinding wheel.

c) The immobilised mobile siloxane

The siloxanes useful in the abrasive compositions employed in the tools of the invention may take a number of different forms, and may be categorised, as convenient, either by their purpose and effect or by their chemical type. From the point of view of purpose and effect a chosen siloxane may, as stated above, be either a friction-enhancing agent or a lubricating agent, it may be hydrophilic or hydrophobic, and it may show enhanced compatibility or reactivity with certain types of chemicals. It might even have a pre-defined bio-compatibility. From the point of view of their chemistry, however, the siloxanes found so far to be useful in this invention are on the whole diorganyl siloxanes of the General Formula $$[—O—Si(R_2)—]_n$$

wherein n is from 3 to 20, and each R group, which may be the same or different, is selectable from hydrogen and a vast range of organic moieties, mostly hydrocarbyl and poly (oxyhydrocarbyl) (including substituted versions thereof) groups with from 1 to 14 hydrocarbyl units. As is further explained hereinafter, the side, or pendant, groups R are the generators of the siloxane's properties; these properties are determined both by the main body of the pendant group and by the particular terminator substituent groups—methyl, hydroxy, thiol, amino, halogen, carboxy, epoxy or ethenyl or ethynyl, for instance. The shorter silicon chain siloxanes—and particularly those wherein n is 3—seem to bond to the underlying metal surface rather more easily and more densely than do the longer chain materials, and this is particularly so for those with the longer pendant chains R.

Moreover, while any particular siloxane will for the most part be used on its own, there may be occasions when a blend, or mixture, of two or more different siloxanes may be appropriate.

i) Friction-enhancing siloxanes

Those tools of the invention intended for shaping by the abrading away of significant amounts of workpiece material rely on the use of a friction-enhancing anti-lubricant diorganyl siloxane.

The medium molecular weight siloxanes (wherein the hydrocarbyl etc groups R are fairly long chain) are oils, and many of these oils have in the past proved to be useful as lubricants. In clear contrast, the siloxanes suitable in the present invention as anti-lubricants are low molecular weight, short-chain hydrocarbyl or hydrocarbyl/hydrogen siloxanes. Indeed, those siloxanes in which the hydrocarbyl groups are short-chain alkyl groups—and specifically those wherein the alkyl groups are methyl groups—seem to be the best anti-lubricants. Accordingly, for use in the present invention there is very preferably employed, as the material promoting the friction enhancement (as the anti-lubricant), a siloxane of the dimethyl or hydrogenmethyl type. Particular silicones are discussed further hereinafter.

The siloxane friction enhancing agent may itself directly promote friction enhancement, or it may do so indirectly, by giving rise under the conditions of use to a material that does itself promote friction enhancement—say, by breaking down chemically into a form that promotes friction enhancement when subjected to the heating (chemical) or shear forces (mechanical) generated during their use. It is believed that the siloxanes, or their break-down products, also act to remove any surface oxide (and possibly to stop such a layer re-forming, perhaps by scavenging free oxygen from the environs; this is thought to be particularly so for the hydrogenmethyl siloxanes).

The anti-lubricant, friction-enhancing action of silicone oils, particularly the polydimethylsiloxanes, was first exploited to gall and join metals as described in the Specification of our International Patent Application WO 91/19, 589 (P1220). Their behavior as friction-enhancing agents is more moderate under the ambient conditions of the rubbing used in the shaping method of the invention, but nevertheless similar materials are suited for use therewith (although in some instances it is beneficial to blend them with other substances, to match operating needs). Preferred anti-lubricant siloxanes for use in the present invention are liquids and of relatively low viscosity (about 50 c/s or less, some as little as 10 c/s). The particularly-preferred medium molecular weight polydimethylsiloxanes are of this sort, especially those materials commercially available from Dow Corning under the Marks MS 200, and Dow Corning 344 and 345, all of which are fully described in the relevant Data Sheets. The 344 and 345 materials, normally used in cosmetic preparations, are respectively blends predominately of cyclic tetramers and pentamers of dimethylsiloxane. Other preferred silicones are mentioned below.

ii) Siloxanes suitable for conditioning

The siloxane need not be an anti-lubricant, friction-enhancer; it may well be desirable, when conditioning a metal part's surface using an excoriating tool rather than shaping it with an abrading tool, to provide that surface with a layer having some other sort of effect (although in fact many of the preferred anti-lubricant siloxanes have, and can also be used for, one or more other conditioning effect). For example, there could specifically be afforded to the metal part's surface a lubricant effect (as opposed to an anti-lubricant one) or hydrophobic or hydrophilic properties. The conditioning characteristics conferred on the surface are governed by the chemistry of the deposited siloxane layer, which in turn is determined by the siloxane backbone and the type of organic side groups it carries. Theoretically, most organic molecules can be incorporated into siloxane side groups in various proportions giving a huge range of potential surface chemistries, many able to participate in yet further organic reactions.

It might be possible to divide the nature of the film into several conditioning categories like these, and then describe individual siloxanes, or groups or families of siloxanes, that provide films affording that conditioning. At the moment, however, it is more convenient to discuss siloxanes generally, and then indicate what sort of effects films using them might permit.

Firstly, the siloxanes hereinbefore described as anti-lubricants also produce strongly hydrophobic surfaces (on irons and steels) which for that reason exhibits good corrosion resistance (specifically against rusting conditions). This is particularly so for the lower molecular weight, and thus lower viscosity, dimethyl siloxanes several specific instances of which have been identified above.

A wide range of poly(oxyhydrocarbyl) siloxanes, and specifically poly(oxyethylene) siloxanes, provides layers having a significant water wettability, and in the case of these poly(oxyethylene) siloxanes at least this is strongly correlated with, and thus is a reliable indicator for, high adhesivity (it should noted, however, that this correlation appears not to hold for other siloxanes, such as the methylate glycines like Goldschmidt 6950, which though providing a wettable surface reduces the adhesivity of epoxies and cyano-acrylates almost to nothing). These poly (oxyethylene) siloxanes can be used to provide a conditioned surface which is a good base for epoxy-amine, cyano-acrylate, methyl-methacrylate and dimethacrylate-methanediol anaerobic adhesives themselves and for similar materials such as the numerous chemically-related paint resins, particularly the epoxy esters. In these latter the establishment and maintenance of adhesion under environmental exposure is a key to the corrosion protection performance of the system, but the corrosion performance is actually enhanced by the presence of the corrosion-resistance conditioning layer. Thus, the actual paint coverage— that is, the thickness of the paint coating to provide a given corrosion resistance—is reduced.

Typical instances of siloxanes that improve adhesivity are

Mazer (PPG) Chemicals SF19 an organofunctional siloxane of viscosity 45 cSt, surface tension (1% aqueous) 20.4 dynes/cm. It is sold as a surfactant, and is thought to have a "tri-silicon" backbone (three silicon atoms with trimethyl endgroups and a central hydroxyalkyl-terminated poly(oxyethylene) pendant group: in some cases the actual terminal group may be a hydroxy group).

OSi Specialties L77 a methyl-terminated nona (oxyethylene) polydimethyl siloxane of viscosity 20 cSt and surface tension (0.1% aqueous) 20.5 dynes/cm. It is marketed as a surfactant, has a molecular weight of around 600, and has a tri-silicon backbone.

OSi Specialties L7607 a methyl-terminated poly (oxyethylene) polydimethyl siloxane like L77 but of viscosity 50 cSt, surface tension (0.1% aqueous) 23.4 dynes/cm, and a molecular weight of around 1,000.

OSi Specialties L7608 a poly(oxyethylene) polydimethyl siloxane like L77 but with a hydroxyl terminating group. It has a viscosity of 35 cSt, a surface tension (0.1% aqueous) of 21.5 dynes/cm, and a molecular weight of around 600.

Th. Goldschmidt 5878 a methyl-terminated poly (oxyethylene) polydimethyl tri-silicon siloxane wetting agent of viscosity 18–28 cSt, surface tension (0.1% aqueous) 21 mN/m.

Th. Goldschmidt 5840 a hydroxy-terminated poly (oxyethylene) polydimethyl tri-silicon siloxane wetting agent of viscosity 50–70 cSt, surface tension (0.1% aqueous) 22 mN/m (this material has radically different behavior to the 5878 siloxane, and it is suspected that this is caused by the (unknown) chain length and terminator.

Slightly surprisingly, some of the siloxanes that produce water-wettable surfaces also provide those surfaces with excellent anti-corrosion properties (but see the remarks above about the Goldschmidt 6950 betaine). It is not entirely clear how this effect is caused, but it is thought that, the siloxane coating being laid down with the silicon backbone lying flat against the metal surface and the pendant side chains projecting out therefrom (this is discussed further hereinafter), any water is trapped by the upstanding hydrophilic pendant layer, the underlying hydrophobic silicon layer completing the barricade preventing the water ever reaching the metal surface.

Oleophilic and oleophobic surfaces can also be formed. Thus, OSi L7500, a butyl-terminated poly(oxyethylene) polydimethyl siloxane with a viscosity of 140 cSt and a molecular weight of around 3000 makes oleophilic surfaces, while the fluorocarbon siloxane Dow Corning FS1265 confers some slight oleophobicity.

One reason for producing a siloxane layer having lubricant rather than anti-lubricant properties is in the area of joint formation, where it may be desirable to enable two metal parts being assembled together to be slid into position one over the next with a reduced risk of galling until the two are correctly positioned for making the galled joint. A siloxane suitable for this lubrication purpose is Goldschmidt 5840.

Blending two or more different siloxanes may be desirable for a number of reasons. For instance, a mixture of Mazer SF19 and a small amount (5–10%) of a 1,200 molecular weight 10 cSt DC200 had an increased average molecular weight and so was more easily retained within its rubbery siloxane carrier composition. Another blend example is one of Mazer SF19 and a small amount of a 100 molecular weight 10 cSt DC200, which showed considerably increased surface activity and wetting/covering power, and as a result formed a denser siloxane layer. Blends with an oxygen-scavenging methyl-hydrogen siloxane may be especially useful for excoriating/conditioning uses.

Those siloxanes that have organofunctional pendant groups—that is, side chains, that contain active groups (such as hydroxy, amino, or reactive unsaturations, and so on, as aforementioned) able to take part in some chemical reaction—may have properties that are much like those of the corresponding basic polydimethyl siloxane. However, if there is a relatively large number of such active groups then the properties of the siloxane (or further-reacted siloxane) can be, or can be made, quite different to those of the basic polydimethyl siloxane.

Shaping objects

In its second major aspect the invention provides a method of shaping an object, in which the surface of the object is abraded away using a coarsely-abrasive tool (as aforesaid) to provide the desired shaped object.

Although the shaping method of the invention could clearly be applied to objects which are made of other hard materials, such as a ceramic or glass, nevertheless it is primarily intended for application to metal objects, and for the most part that is how it is described hereinafter.

In the discussion of the possible tool types given hereinbefore much has already been disclosed about the method of using them to abrade and shape objects. Moreover, the Specification of our first aforementioned Application (P1285) discusses abrading and shaping in some detail, and it is not necessary to repeat that at this time. Nevertheless, it might be useful to summarise the matter as follows.

The shaping method requires there to be caused significant rubbing friction between the tool and the workpiece surface, and thus is particularly useful in heavy duty applications such as plunge and creep-feed grinding.

The method involves the surface of the workpiece being locally heated and sheared by the continuing tool-derived frictional forces coupled thereto, which depend on tool speed; speeds in excess of 10 m/sec are satisfactory for grinding but lower speeds are sufficient for lapping.

Conditioning surfaces

In another major aspect the invention provides a method of providing a metal part with a surface carrying bonded thereto a surface-conditioning siloxane layer, which method is characterised by first excoriating the part's surface under oxygen-excluding conditions and optionally in the presence of a siloxane, to clean off the oxide film therefrom and to leave the metal surface bare and oxide-free, and then further rubbing the bare metal surface in the presence of a siloxane in a substantially non-abrasive manner to form on the clean surface the desired layer of siloxane molecules individually bonded directly thereto.

So far, the invention has been described mostly in connection with what might be called the "bulk" removal of material from an object by abrasion, so as actually to cut into the surface and so shape the object. However, as has been noted it is also applicable to the treatment of a surface in which only the smallest amount of material is actually removed—possibly just enough to clean the surface of any residual dirt or corrosion or oxide layer thereon—and as such an aspect the invention is a method of conditioning a surface for some subsequent purpose. This concept—conditioning the surface for some further purpose—is not disclosed or foreshadowed in the first above-mentioned Application (P1285), and is now described in some detail.

Firstly, the types of tool employed for conditioning—the excoriating tool—are those where there is used a flexible substrate (so as not to transmit too much force to the tool as it rubs over the surface) and a very fine abrasive (so as to keep the possible abrasion down as far as possible). A flexible, soft tool is more able to follow the contours of the surface and so reach into dips or troughs therein and thereby provide better coverage.

Secondly, the reasons for carrying out the conditioning—the benefits expected as a result thereof—are diverse. More specifically, the surface might be conditioned to instil and retain for future use the mobile siloxane layer as: a plastic lubricant for running plastic or rubber seals against; a metal-to-metal boundary lubricant; a metal-to-metal anti-lubricant (the very opposite of a lubricant) for conferring on the part the ability to make galled joints; an anti-corrosion layer for keeping water or other corrosive liquids off the metal surface; a water- or oil-wetting agent; a keying layer to which a subsequent layer of adhesive or paint would strongly bond; a catalytic layer able to participate in some further reaction; or as a passivated layer to achieve environmental, for instance bio-, compatibility.

In order to prepare the siloxane-coated surface the relevant area of the metal part's surface is first excoriated in the presence of a siloxane, and is then further rubbed in the presence of the same or a different siloxane. The primary reason for the presence of the siloxane during the first stage is because it serves to keep ambient oxygen away from the cleaned, oxide-free surface (this may be by it forming a physical barrier and/or as a result of its oxygen-scavenging ability). In addition, it also initiates the formation of the desired bonded siloxane layer onto that surface (this formation subsequently being completed in the second stage).

The preparation involves cleaning the metal surface by the removal therefrom of any dirt and oxide film thereon (it will be understood that the surface thus rubbed and cleaned is that portion or area of the surface on which it is required to form the siloxane layer; this may be any amount ranging from the whole to only a small but nevertheless significant fraction of the metal part's area). This cleaning is a mechanical process; the dirt, oxide and other surface contamination are simply scraped off, and moved away to one side, leaving bare, "pure" metal behind. In fact, some metal is likely also to be scraped off, but it is not the purpose of the conditioning method to remove any significant amounts of metal—this aspect of the invention involves not shaping the surface, merely cleaning it—and so too much abrasion, either inherently or with time, which produces large amounts of swarf that are difficult to remove without admitting more free oxygen, is to be avoided (once the surface is clean, that is enough). That having been said, a very small amount of metal removal—smoothing away the tips of the surface's microprojections—is bound to happen, and may be beneficial in that it reduces surface roughness.

The bare metal surface produced is highly reactive; it needs to be protected from ambient oxygen—or, indeed, other reactive contaminant materials—and that is what the siloxane present does, both by creating a physical barrier and by being an oxygen scavenger. The conditioning method of the invention first excoriates in the presence of a siloxane and under oxygen-excluding conditions, and then further rubs it again in the presence of siloxane. Doing the excoriation under oxygen-excluding conditions (necessary to reduce the possibility that ambient oxygen seeping back onto the cleaned metal surface could replace the oxide layer as fast as it is removed, and so prevent the direct bonding of the siloxane molecules) can be effected in a number of ways. One, obviously, is to carry out the operation in the actual absence of oxygen—in an inert atmosphere (of nitrogen or an inert gas, say), and this might be appropriate in some cases. A much simpler way, however, is to excoriate the surface, and apply the siloxane, using a rubbing, abrasive tool that completely covers (or masks) a relatively large area at a time, and is moved (to rub) in small circles or zigzags that gradually translocate across the surface (like one polishes a table or a car); in this way the central area that is being cleaned is always surrounded by tool-bearing siloxane that itself provides both a mechanical and a chemical barrier to the ingress of ambient oxygen, and by the time the tool has moved away from that area the bare metal has already acquired its siloxane layer.

Once the preliminary cleaning stage is over the thus-cleaned surface is further rubbed in the presence of siloxane such that there is formed directly on the surface a siloxane layer made up of siloxane molecules each individually bonded to the underlying metal. Usually, this "second stage" will be a seamless continuation of the first stage; as noted hereinbefore, the mildly-abrasive rubbing in the presence of a siloxane causes initiation of siloxane-layer formation, as the siloxane present binds to the exposed clean metal surface as it is formed. It may, though, be the case that this subsequent rubbing is conducted as a distinguishable, separate, stage—for example, the cleaning abrasion of the oxide-covered metal surface may be effected with an abrasive flapwheel (and a first siloxane), and immediately thereafter the clean, oxide-stripped surface may be rubbed with a cloth soaked in (possibly a second) siloxane. A second, different siloxane might be used when the desired conditioning effect is only provided by such a siloxane that is not itself satisfactory for use in the preliminary oxide-film-removal excoriation stage. For example, the excoriation is best effected utilising a thin, mobile siloxane, but the required conditioning siloxane might only be available as an unsuitably thick, viscous material (which is applied after cleaning the excoriated surface of any residue of the first stage).

It is not entirely clear how the conditioning siloxane bonds to the cleaned underlying metal surface, nor how it confers on that surface the required properties. As to the former, though, it is thought that once the starting oxidised metal surface has been cleaned by abrasive action to reveal the underlying metal, which is chemically unstable, with many broken interatomic bonds and so is extremely reactive, then the individual molecules of the free siloxane preferentially bond to the thus-cleaned surface in place of any remaining oxygen in such a way that the siloxane's silicon-oxygen chain ( . . .—Si—O—Si—O—. . . ) lies flat across the surface, with its oxygen atoms adjacent and linked thereto, while the side groups project up out of and away from the reactive surface, and are screened therefrom by the silicon atoms.

The formed siloxane layer has significant effects. For example, it is thought that other functional materials can be chemically reacted to this bonded layer as a means of creating and controlling surface conditions even further. For instance, it would be possible to react a further chemical to the siloxane's pendant chain terminal groups if care was taken to ensure appropriate functionality, this second-reacted chemical possessing other "functionality", possibly a hydrocarbon chain, to provide lubrication properties or anti-corrosion properties, or some sort of bio-compatibility.

This type of modified surface, in which siloxane is directly bonded to most of the substrate material so that the normal behavior of the surface (which is due mostly to the all-covering natural oxide layer) is radically altered, is believed to be unique. It is believed, moreover, that a surface treated by this method will retain the siloxane bonds indefinitely if kept away from those chemicals, such as some acids and bases, known to attack siloxanes. Hence it should be possible to treat surfaces during manufacture for later functional use—perhaps several years later—or to provide surfaces with an effect such as friction-enhancer functionality guaranteed for life. On iron and its alloys the siloxane's action is likely to result in the formation of some iron silicates, known for their tenacity when bonding to iron oxide surfaces, but it is believed the bulk of the deposited silicaceous material will remain as a polymer that is chemically, or polar, bonded direct to unreacted iron, and is therefore available to provide conditioning.

In this connection it has been noted that finely-abraded iron surfaces prepared using a paper with an abrasive-loaded absorbed rubbery siloxane composition do have a significantly improved resistance to oxidative corrosion (rust). Preliminary tests have shown this resistance to be effective against condensed water droplets, and to a lesser extent against brine and hydrochloric acid attack. The concept described here of using a mild abrasive to disrupt oxide layers to allow intimate bonding (plating-on) of a protective water-repellent layer of siloxanes seems attractive as a potential method of treating many surfaces as an alternative to the chemically-polluting electroplating systems commonly used at present. In particular, it has been observed that, after wiping clean after abrading, the surfaces appeared to retain their water-repellency and corrosion-resistance features indefinitely.

The conditioned metal surface per se

Finally, one further facet of the invention is the metal parts themselves carrying the siloxane layer thereon, and so in this aspect the invention provides a metal part with a conditioned surface having siloxane molecules each individually bonded directly to the metal over a relatively large area of the surface to provide a relatively uniform siloxane layer.

Although this aspect of the invention is discussed in more detail below, it would seem desirable first to explain why such a concept—metal surfaces with a siloxane layer thereon—is believed to be both novel and inventive despite a wide variety of Art relating to the formation of silicone coatings on metals.

It is common to apply silicone polymer films to a metal surface. Indeed, it is known to polymerise the monomeric materials directly at the surface for the purpose of providing the surface with improved or different properties (such as being corrosion-resistant or a good paint- or adhesive-base). However, for the most part all these prior silicone polymer layers have been formed on, and adhered to, the oxide layer already present on the metal surface (indeed, in many cases they are designed specifically to interact with the oxide layer, this supplying the tie between the polymer and the underlying metal). The adhesion of the polymer layer to the oxide layer, and thus to the underlying metal, is not always as good as might be hoped, and in a related situation where adhesion-promoting silane layers are said to be formed on metals via the oxide-layer the latter has been described as being partially (chemically) etched off—but by partially is meant that over its entire extent it has been thinned by the etching process, so it still covers the entire metal surface but is not as thick (and perhaps now lacks the looser upper layers) as it started out, so that the silicon material is still, but more firmly, attached to oxide and not to metal. Such layers attached to a thinned oxide layer are said to adhere better than those where the oxide layer has been left alone.

A case of silicone-polymer-layer-attachment arguably not via the oxide layer is where the oxide layer has been partially removed but haphazardly, and quite by accident, in small areas spaced randomly over the surface; this appears to be the case where siloxane lubricants in bearings are described as having failed under extreme conditions, allowing the bearing to seize (subsequent examination of the seized surfaces revealed that they carried a thin film of silicone polymer apparently adhered directly to the underlying metal, but this layer was in very-small-area patches distributed non-uniformly over limited parts of the surface).

In the Specification of our first aforementioned Application (P1285) there is described and claimed a method of shaping a metal workpiece by removing material from its surface, in which method the surface of the workpiece is continuously "rubbed" by a tool in a friction-inducing manner and in the presence of a friction-enhancing agent in a quantity and in a form such that actual friction enhancement occurs, and at least some of the surface material in frictional contact with the tool is sheared from the workpiece surface by the continuing motion of the tool, and discarded. The whole purpose of this method is to remove material, and there is no interest in the nature of the surface, or any layer formed thereon, save that during the material-removal oxygen should be excluded from the surface at the tool/surface interface.

The Specification discusses what takes place in the immediate area of tool/workpiece contact—that very small area in actual rubbing contact. What happens is that, in the presence of a friction-enhancing silicone, the inevitable oxide layer is first mechanically disrupted to reveal bare metal—this is thought to occur simultaneously with the thermal degradation and physical breaking of silicone molecules "trapped" in the contact area into smaller moieties which themselves have an oxygen-scavenging capability and so react with any available oxygen to prevent it attaching to the bare metal surface and reforming the oxide layer (the greater the tool/workpiece contact forces the more extensive the formation of the desired oxygen-scavenging moieties)—whereupon the tool microwelds to a myriad of microscopic areas of the bare, oxide-free surface (this microwelding is more extensive than it would be without the oxygen-scavenging action of the silicone), and its subsequent movement then necessarily tears minute slivers of metal off the workpiece. Once the tool has moved on, taking the torn-off metal with it, there is left, for a very brief instant, a corresponding tiny area of bare metal—but that instant is brief, being of the order of microseconds, because, in the absence of any positive attempt to exclude ambient oxygen from the surface, the bare patches are almost instantaneously and preferentially re-covered in an oxide layer.

It might be thought that, the metal-tearing rubbing having been effected in the presence of a silicone, this renewed onslaught of ambient oxygen would be resisted. However, in the circumstances of the metal-shaping operation of this prior Specification such is not the case. While it is believed that the silicone moieties generated by the tool's physical breaking-down of the silicone molecules have oxygen scavenging properties, this is not—or does not seem to be—the case with the silicones themselves; they have no significant oxygen scavenging capability. Moreover, while there may be some "unused" silicone breakdown products left behind adjacent the bare metal revealed as the sliver is torn off, in the absence of any positive steps to exclude ambient oxygen from the site these are unable, or insufficient, to prevent that relatively reactive oxygen flooding onto the bare metal and re-forming the oxide layer. And in this context it is worth noting that the silicone materials used in such a metal-shaping method are usually rich in dissolved oxygen, and may even be supplied to the site by a physical process which causes oxygen to be entrained (such as the normal use of a water-based flood coolant for a grinding wheel).

It should be appreciated that under the conditions of the metal shaping method of this prior Specification at no time is a siloxane layer formed anywhere bonded directly to the metal surface—and specifically not on the formed clean, bare metal patches.

In the Specification of our second aforementioned Application (P1220) there is described and claimed the formation of galled joints by a method involving the application of gall-promoting—that is to say, anti-lubricant—siloxanes to opposed metal surfaces which are then briefly rubbed together to cause random gall formation which binds the surfaces together (and so forms the joint). It is likely that during this brief gall formation there is some haphazard and incidental siloxane-layer creation as the gall-producing metal is transferred from one opposed surface to the other, revealing fresh clean metal which is then exposed to any remaining siloxane. It is even possible that there may briefly and fortuitously be produced an uneven layer of siloxane actually bonded onto the metal surface. However, this siloxane layer, if it occurs at all, is transitory in the extreme, being in existence for merely the few milliseconds necessary for the joint to be made. It is quite different from the long-term, uniform, dense, large-area siloxane layers the subject of the present invention. The conditioned-surface metal part of the invention is quite different; the metal surface has the siloxane molecules individually bonded directly to the metal over a relatively large area of the surface to provide a relatively uniform siloxane layer systematically controlled.

This final facet of the invention is the metal parts themselves carrying the siloxane layer thereon—a metal part with a conditioned surface having siloxane molecules each individually bonded directly to the metal over a relatively large area of the surface to provide a relatively uniform siloxane layer.

As will be clear from what has gone before, the metal part may be of almost any sort depending upon its purpose and the purpose of applying the siloxane coating. Thus, it may be a sheet of steel which is to be given an anti-corrosion paint-adhesion layer, or it may be a part of a joint—an axle, say—to be galled to some other part—a cam or gear wheel. Or it may be a length of strip that is eventually to be glued to some other object, and so requires an adhesive-base conditioning layer. In each case the formed siloxane coating will need to cover a relatively large area of the part, and will need to be uniform thereover.

The siloxane will be chosen for the properties it can confer. This, and the chemical nature of the siloxane, has already been discussed hereinbefore, and needs no further comment here.

EXAMPLES

The following Examples are now given, though by way of illustration only, to show details of the various aspects of the invention.

A primary objective is to provide an abrasive composition of a rubber-like carrier compound in which a low molecular weight, relatively free siloxane is retained, trapped but capable of being released onto a surface either of a tool or of a workpiece treated using that tool, and wetting that surface. The carrier matrix must be able to hold the siloxane indefinitely both in storage and in use without it leaching or creeping out beyond the treated area of the tool. A second objective is to provide a tool to which the composition has been applied, and to use that tool in a shaping or excoriating/conditioning method. A third objective is to form differently-conditioned surfaces using one or more of a range of siloxanes.

Shaping compositions and tools

Example 1

Preparation and Use of a Composition for Treating a Grinding Wheel

The rubbery friction-enhancing agent composition

At room temperature a 150 ml mix was prepared in the following proportions by volume:

- 20% Masil 28 (a copolymer material comprising principally polydimethyl siloxane with about 80 monomer and about 4 monomers with reactive acid anhydride side groups)
- 25% Dow Corning 109 (a fairly long chain polydimethyl siloxane with reactive hydroxyl end groups)
- 50% Dow Corning 200/100 (a non reactive linear polydimethyl siloxane to act as the free slow release friction-enhancer)

To this was added a 5% stannous octoate to catalyse the mixture.

The abrasive 5 grams of 320 grit fused alumina were brushed evenly over the surface of a 200 mm diameter by 20 mm deep Norton 38A46LVS wheel, brushing towards its outer rim, and then vibrated into the wheel using a pneumatic hammer.

Applying the composition

The siloxane mixture was then poured onto and spread evenly over the surface of the wheel. Both sides of the wheel were coated, and the entire mix was easily absorbed into the porous structure of the wheel. The composition appeared to cure to a soft rubber in less than 2 hours within the wheel.

A separate sample applied to a open flat glass surface actually cured to a stiff rubber in less than 30 minutes.

Tests

A simple comparative grinding test was performed comparing an abrasive-composition treated wheel (wheel A) with both an untreated wheel (wheel U) and a wheel treated only with the siloxane composition (without the abrasive: wheel S).

On test against soft steel wheel S was seen to show the characteristic behavior of a siloxane-treated wheel (as detailed in our first aforementioned Application [P1285]) of cutting rather faster than untreated wheel U, and of removing more metal per dressing. For wheel A, for grinding a soft metal specimen there was no difference in performance over wheel S. However, on grinding a hard specimen there appeared to be an improvement in grinding efficiency; the higher the wheel load (force of workpiece pushing against wheel), the greater the improvement in metal removal rate.

Example 2

Preparation and Use of an Alternative Composition for Treating a Grinding Wheel The rubbery friction-enhancing agent composition At room temperature a 150 ml mix was prepared in the following proportions by volume:

- 10% Masil 28 (a copolymer material comprising about 80 monomer units, 4 of which are said to have reactive acid anhydride side groups, the remainder being passive dimethyl and using methyl terminal groups)
- 20% Dow Corning 109 (a fairly long chain polydimethyl siloxane with reactive hydroxyl end groups)
- 10% Rhone Poulenc V48/100 (a low viscosity polydimethyl siloxane with reactive hydroxyl end groups)

(Note that the proportions of these hydroxy materials determine the hardness of the cured rubber—the higher the 109 the softer the rubber).

- 55% Dow Corning 200/50 material (a passive polydimethyl siloxane for use as the friction-enhancer)
- 5% Stannous Octoate (to act as a catalyst)

The abrasive

As in Example 1, 5 grams of alumina 320 grit powder was vibrated in to a Norton 38A46LVS wheel.

Applying the composition

The prepared rubbery composition mixture was applied as before to the wheel. It appeared to cure in the wheel in less than 2 hours, and was dry to the touch on an flat glass surface after 45 minutes. The material gave a slightly stiffer rubber than those in Example 1, and appeared to provide a greater siloxane feel to the actual grinding surface of the wheel.

Tests

On test this was seen to perform similar to the wheel of Example 1.

Example 3

Preparation and Use of an Abrasive-Loaded Rubber for Moulding Into a Tool

The rubbery friction-enhancing agent composition

At room temperature the following mix was made, all measures being by volume:

8% Masil 28 (the copolymer described in Example 1 above)

16% DC109 (as described in Example 1)

8% RP48V/100 (a polydimethyl siloxane with linear chains and reactive hydroxyl end groups))

46% DC 200/100 (as friction-enhancer, as in Example 1)

18% fused alumina powder 320 grit size

4% tin octoate (as catalyst)

The above was mixed thoroughly, and when the reaction was clearly establish, as evidenced by many small bubbles and after about 10 minutes mixing, it was poured into a mould. It took about 4 hours to cure.

After leaving for about 24 hours the cure appeared complete because the rubber was dry to the touch and failed to gain further strength.

The formed tool could be used for lightly abrading a steel surface. The tool actually wet the surface with siloxane, and deposited a quantity of fine abrasive on the surface also. Hence, this tool is suited to either wetting another tool by allowing it to run against it, like a linisher belt, or as part of a two-part tool system where this tool prepares the surface by coating a surface with the friction-enhancer and abrasive ready for final polishing off with a dry buff.

Example 4

Preparation of a Grinding Wheel Shaping Tool.

Stage A: Preparation of an (abrasive) composition

At room temperature a particularly preferred mix was prepared as follows:

30 ml 48V50 or 48V100 for slightly tougher rubber (Rhone Poulenc siloxanes)

75 ml 200/50 (Dow Corning siloxane)

20 ml 200/10 (Dow Corning siloxane)

20 ml Y-11343 slow cure/soft; A-1120 fast cure/hard (silanes from OSi Specialties)

5 ml stannous octate (polymerization catalyst)

(the constituents may be varied as shown to adjust the rubber to suit the application; all the rubbers are deliberately weak so they do not ball up and wedge under and lift the tool off the work-piece at low contact forces). The materials were mixed thoroughly to give a fluid composition with a shelf life dependent on the particular silane cross-linker (six hours for the Y-11343; about 30 minutes or less for the A-1120).

The result was a rubbery friction-enhancing agent composition that in use rapidly decomposes at the abrading surface to prevent tool work-piece separation.

Stage B: Preparation of a shaping tool 5 grams of 320 fused alumina grit were vibrated into a Norton 38A46LVS grinding wheel evenly within a 25 mm band near its periphery. The mixed composition was then poured onto the grinding wheel (held horizontally) which absorbed it completely, and allowed to cure at room temperature (this took about 24 hours and 1 hour respectively).

Alternate Stage B: Preparation of other shaping tools

The same composition was also used to provide a grinding disc and a linishing belt with a secondary abrasive surface, in accordance with the invention. First, the disc or belt was dusted with 320 fused alumina grit mixed with 1% by weight Degussa Aerosil 200 (fumed silica: a thickening agent present to cross-link the siloxane and so strengthen the rubber in the valleys between abrasive on the disc or belt surface).

Grinding test

The formed grinding wheel tool of the invention was then used to cut into mild and hard steel test specimens, and compared in this with an untreated wheel and a wheel as treated in accordance with the invention the subject of our aforementioned International Application (P1285). Both treated wheels were comparable on mild steel and at low loads to the untreated wheel, but were significantly better as the load increased. Moreover, on hard steel the present invention's tool performed considerably better than that of the previous one.

Similarly beneficial results were achieved when using a grinding disc of the invention.

Example 5

Preparation of a Grinding Disc Shaping Tool

Stage A: Preparation of a gel-like rubbery abrasive composition

At room temperature, a pre-mix of 2.5 ml Masil 28 (PPG/Mazer siloxane), and 2 ml DC1107 (Dow Corning siloxane)

and a pre-mix of 1 ml RP21637 (Rhone Poulenc siloxane) and 2 ml DC1107 (as above)

were sequentially added to 1 ml DC1107 in a beaker and blended in for 1 minute. 0.5 ml water was then added, and the whole was stirred for a further minute. At this stage the resulting composition was a milky semi-viscous liquid.

Stage B: Preparation of the shaping tool

70% of the contents of the beaker were then poured onto an 180 mm diameter coated abrasive disc that had previously been lightly dusted with 0.5 g fused alumina 320 grit, and spread evenly over disc surface by brushing in with a small paint brush and left for 24 hours to cure. At that time the composition was tacky.

The material left in the beaker became a solid gel after four days; the disc was still tacky after seven days, but eventually became dry to the touch.

Tests

A simple comparative abrading test was performed contrasting the abrading rate of the treated disc shaping tool against an untreated disc operating under identical conditions.

The torque load was progressively increased by increasing the rubbing pressure of the tool against the workpiece. At low loads there was no perceptible difference between the treated and untreated discs, but as the contact pressure increased so the torque load rose more rapidly on the treated disc. At the point where the drive was just able to maintain its rated operating speed, it was found that the treated disc removed soft steel at a rate 30% higher than that attained by the untreated disc; it was also found that the drive current required (for the electric motor driving the disc) at this cutting rate was between 10 and 15% higher for the treated than the untreated wheel operating at the same rubbing contact pressure.

Excoriating compositions and tools

Example 6

Preparation and Use of Abrasive Paper Wipes

The rubbery friction-enhancing agent composition

The mix was prepared using the formulation detailed in Example 3 above.

Approximately 5 ml. of mix was poured onto a strip of 80 g/mm$^2$ Absorbex paper (50 mm.×250 mm.) supplied by Laminating Papers Ltd Kanavaranta 1, SF-00160 Helsinki, Finland. This was spread evenly over one side only, and the fluid soaked into the paper leaving most of the abrasive on then surface.

The strip was left to cure for about six hours, after which it could be used as an effective excoriation tool.

Tests

Evidence of its effectiveness at metal oxide removal was seen by the rapid discoloration as iron oxide rapidly turned the surface black. The wipe would leave a smear of friction-enhancer on the surface together with a scattering of fine abrasive. By turning the wipe over and using the side without abrasive the surface could be further polished. Again there was clear evidence of oxide removal, because the wipe side without abrasive actually discoloured black when the surface had previously been polished with the abrasive side. However, save for the removal of some surface dirt when the abrasive free side was rubbed against a new steel surface, the side without the abrasive barely marked the surface (the removal of the dirt was attributed to the wetting effect of the released siloxane from the soaked wipe acting as a degreaser).

Example 6A

Preparation of a Mild Steel Surface with Improved Corrosion Protection

A 75 mm×50 mm cold rolled mild steel plate was degreased and wiped clean. The surface was without any sign of corrosion.

A wipe, as prepared in Example 6 above, was used to polish half the surface of the plate. Polishing was done by hand with only light pressure, first using the abrasive coated side of the wipe for about half a minute and then with the uncoated side of the wipe for about half a minute. The polished surface was then wiped to remove remnants of paper, abrasive and surplus friction-enhancer.

The polished surface appeared dull grey, and was in fact was less shiny than the unpolished cold rolled original surface.

Tests

The plate was then half immersed in domestic tap water for 2 hours, then removed and allowed to dry.

Rust pits developed around the drying areas on the untreated surface, but the abraded surface showed no sign of corrosion. After 10 days standing in the open laboratory there was still no sign of corrosion on the treated surface, while the untreated surface had become quite rusty.

The experiment was repeated using water with 1 wt % sodium chloride added, and this showed much more aggressive corrosion (rusting and staining) of the untreated surface, while the treated surface showed staining with drying marks, and a few tiny rust pits that did not grow beyond pin head size. After two weeks in the open air the untreated surface was completely covered in red rust, whereas the treated surface was still 50% clear of corrosion.

The experiment was repeated using water with 5% hydrochloric acid (28° TW) added. The surfaces above the water corroded within 5 minutes due to the vapours released. The treated area appeared to be a lighter red and with a much finer texture than the untreated, and the severity of corrosive attack appeared less on the coated area. The immersed section did not significantly corrode on either the coated or uncoated section, but the treated section appeared to have a light and more natural steel colour than the untreated. It looked as if the untreated surface had stained.

There were signs of slight rust developing after two weeks standing in the open laboratory, around dry marks on both of the immersed sections, these dry marks being from a water wash to remove residual acid.

Thus, it was established that by abrading a steel surface by the method of the invention the risk of minor corrosion due to fresh water attack is much reduced. Salt water corrosion is slightly reduced, and acid resistance is changed.

Example 7

Preparation and Use of a Laminated Paper Abrading Tool

The rubbery friction-enhancing agent composition

A liquid formulation was prepared as in Example 5 above. It was then used to treat six strips (50 mm.×250 mm.) of 30 g/mm$^2$ Absorbex paper (3 ml of liquid were applied evenly to one side of each strip, and allowed to soak in).

The strips were then placed on top of each other to form a laminated board which was then gently pressed into what ever tool shape was required (in the case of the proving sample it was pressed flat).

After curing for about four days the board became relatively stiff and could be used initially without backing, as an abrasive tool.

Tests

At least four of the six layers were worn away in the experimental trials, and the tool was still releasing an adequate supply of abrasive and friction-enhancer.

The test was repeated with a steel backing plate bonded directly to the last layer using the gel-like friction-enhancer carrier as the bonding medium. This back plate bond proved to have adequate strength to withstand the shear loads imposed when hand-abrading flat mild steel surfaces.

Example 8

Preparation of Paper and Cloth Excoriating and Conditioning Tools

Stage A: Preparation of an abrasive composition

At room temperature the following mix was prepared:

- 1.5 ml 48V50 (Rhone-Poulenc siloxane)
- 4 ml SF19 (Masil PPG hydrophilic, lubricant, siloxane) or 200/50 (Dow Corning hydrophobic, anti-lubricant, siloxane)
- 1 ml 200/10 (Dow Corning siloxane)
- 0.5 ml A-1120 (OSi Specialties silane)
- 4 drops stannous octoate (catalyst)

These were all mixed together, with stirring. The result was a rubbery composition, suited to retaining low molecular weight conditioning siloxanes and anti-lubricant siloxanes, that also acted as an adhesive to retain abrasive particles on a surface.

Stage B: Preparation of a paper conditioning (excoriating) tool

The formed composition was applied to 10 different 80 gm2 Absorbex Kraft paper strips 25 mm wide by 280 mm long from Laminating Papers Ltd. Kotka, Finland.

Each strip was first lightly dusted with a layer of dry 320 grit abrasive white alumina powder admixed with about 1 wt % Degussa Aerosil 200 fumed silica (to add strength to the rubber layer bonding the abrasive grains to the surface). The actual amount of abrasive used should be chosen to be that appropriate to the subsequent use of the tool; for hand tools only the lightest dusting is needed, and this was simply achieved by sweeping a small amount of the abrasive mix across the surface with a small brush so that the abrasive filled the undulations in the surface.

The siloxane mixture was then poured as a thin line down the centre of the strip, and allowed to soak out towards the edge (it is advisable to do this with the strip horizontal on a non-absorbent surface to prevent the low molecular materials seeping out before the rubber cures). The rubber cured in about 1 hour; the paper was stretched horizontally and rotated slowly whilst soaking and curing.

Alternate Stage B: Preparation of a non-woven cloth conditioning (excoriating) tool Carrying out the invention with non-woven cloth makes a similar product except that more rubbery composition is absorbed, and the surface undulations being larger it traps more abrasive. Hence, a tool made with similar size strips of HWC 35 or HWC 50 (light, and slightly heavier, grades of 80% polypropylene/20% cotton blends supplied by Bonded Fibre Fabric Ltd. Bridgewater, UK), lasts longer and has greater physical strength due to the stronger material (though care must be taken here to orientate the strip along the axis of the material weave with the highest strength and least extension).

Tests

1. Test for anti-corrosion conditioning

A degreased metal plate 100×75 had half its surface excoriated with an SF19 paper wipe (the hydrophilic one) for one minute, and was then washed in ICI EVOLVE CH15 (a volatile blend of hydrocarbon solvents) and dried, then subjected to a corrosion test of 10 cycles of wetting and drying with rain water. After this, 80% of the untreated area was covered in rust while only 5% of the treated areas was rusted. The surface was hydrophilic, and wetted fully.

A further paper wipe prepared with Dow Corning 200/50 material (a hydrophobic anti-lubricant) in place of SF19 showed similar corrosion properties. This surface was hydrophobic, and showed high water droplet contact angles of the order of 90°.

2. Test for lubrication and anti-lubrication behavior

In a further test two similar paper wipes were tested for their lubrication (SF19) and anti-lubrication (DC200/50) properties. A batch of twelve mild steel hubs 10 mm deep were machined with an outside diameter of 35 mm and a bore of 18 mm. A set of matching shafts 50 mm long was prepared with a nominal interference fit of 15 microns.

Two shafts were washed in ICI CH15, and dried before being forced, otherwise untreated, into hubs—so the end of the shaft was flush with the hub face—with an average assembly force of 24 kN. A second two shafts were similarly washed, then smeared with DC200/50, and then washed again to remove any material not actually bonded to the surface, and then assembled into their hubs with an average 24 kN (no difference, as might be expected).

Another four shafts (and bores) were excoriated with lubricating SF19 wipes, then they were thoroughly washed with more CH15 (to remove any unbonded siloxane and loose abrasive grains), and then forced together. The average force required was 21 kN, a reasonable decrease showing that the surfaces had been given some lubricating conditioning.

A third set of four shafts (and bores) were excoriated with anti-lubricating DC200/50 wipes, and then forced together. The average force to assemble these was 63 kN, this showing a considerable increase in friction due to the anti-lubricant surface-conditioning action.

Example 9

Conditioning Metal Surfaces

This Example concerns the conditioning of metal surfaces for various purposes—such as improving adhesion of glues and paints thereto, and for providing enhanced corrosion resistance—and using various different appropriate types of siloxane. The Tests then carried out were comparisons between the intended (conditioning) effect—adhesion, say—of a dry clean abraded steel surface and that of similar surfaces after excoriation with one of 16 different siloxane formulations.

Adhesion Test

In this Test two metal plates are stuck together in a nominally 10 mm overlap along one edge.

Two 18 swg mild steel plates (100×75 mm) were degreased in CH15, and wiped dry. A strip between 10 and 25 mm wide was excoriated across one 75 mm edge, using a wooden block with a flat 10×'mm face around which was wrapped Norton Durite T426 abrasive paper with P400-A grit. A few drops of the appropriate conditioning fluid—see the Table below—were placed on the surface and gently rubbed into the surface with a progressive circular motion of the excoriation block. After about 30 seconds the surface was covered in a blackened liquid, evidence that much oxide had been removed; this was wiped off with a dry paper towel, and the surface was then washed in CH15 and dried.

Adhesive (see below) was applied to each excoriated surface, and these were placed in contact with overlaps of about 10 mm, and firmly clamped, the overall assembly then being 190×75 mm.

One of the adhesives used was an epoxy resin glue—it was a two-pack epoxy-amine similar to Ciba Polymers 2012, a rapid cure general purpose adhesive. The other was a cyanoacrylate glue—it was Loctite Super Glue 3 (based on an ethyl-2-cyanoacrylate). All the epoxy specimens were given a 24 hour room temperature cure, and all the cyanoacrylate specimens were given a 4 hour room temperature cure.

The glued metal sheets were then subjected to the well-known peel test—that is, a controlled attempt was made to lever them apart (one is held stationary while an increasing force is applied to the free edge of the other in a sense to lever it away from the one). The peel test was adopted because it is an easily-reproduced means of comparing the relative adhesive strengths of joints in tension (this test is believed to be less influenced by small differences in surface roughness between specimens than is the other standard tensile shear test, in which the two plates are pulled apart in a sliding sense).

For the particular version of the peel test used here, on the assembled joint one plate was clamped horizontally and securely between steel jaws at the edge of a bench, and a weight was hung off the end of the protruding "under" plate 100 mm from the jaw edge. The weight was progressively increased until the joint yielded. The distance of the top of the overlap from the jaw edge was measured, and the peel strength was then calculated.

Corrosion Test

In this Test treated metal plates are allowed to get rusty.

One half of the surface of a similar 100×75 mm steel plate was excoriated and treated (in exactly the manner described above, and with the same range of materials) for about 1 minute, then wiped clean and washed as above in CH15. The complete surface was then wetted with rain water, and left to dry. This was repeated 10 times, and then the percentage area covered in red rust was estimated. The results in the Table below compare the treated half of each plate with its untreated half.

TABLE

| | | Average values & % change over 5 tests | | | | | |
|---|---|---|---|---|---|---|---|
| | | Adhesion | | | | corrosion | |
| | | Epoxy | | Cyanoacrylate | | | Rust |
| Test No: | Silicone Conditioning Material | Peel N/mm | % Chg | Peel N/mm | % Chg | Before | % cover After |
| 1) | Comparative Conditioned Surface (Dry Abraded Surface) | 4.9 | — | 3.7 | — | — | — |
| 6) | Polydimethyl-linear DC200/50 | — | — | 4.2 | +13 | 75 | 10 |
| 7) | Methylhydrogen-linear DC 1107 | — | — | 4.3 | +16 | 75 | 5 |
| | Aminofunctionals-linears | | | | | | |
| 8) | RP 1300 (monoamine) | — | — | 4.0 | +8 | — | — |
| 9) | RP 21637 (diamino) | — | — | 3.8 | +3 | 85 | 5 |
| 10) | Amino Silane-OSi Y11343 X-linker | — | — | 4 | +8 | — | — |
| 11) | Organofunct. silane blend OSi Y11597 X-linker | — | — | 6.6 | +78 | — | — |
| 12) | Acid Anhydride copol-Masil 28 | — | — | 9 | +142 | — | — |
| 13) | Alpha/Omega modified linear organic wetter Goldschmidt3130 | — | — | 10.3 | +189 | 65 | 35 |
| | Polyethylene Glycols | | | | | | |
| 14) | Goldschmidt 3020 (OH) | 8 | +63 | 6 | +62 | — | — |
| 15) | Goldschmidt 5840 (OH) | 6.7 | +37 | 4.8 | +30 | 65 | 65 |
| 16) | Goldschmidt 5878 (Me) | 9.1 | +86 | 9.3 | +151 | 65 | 5 |
| 17) | OSi 7607 (Me Terminal) | 9.3 | +90 | 9.8 | +165 | 85 | 8 |
| 18) | OSi 7608 (H Terminal) | 10.3 | +110 | 10.7 | +189 | 80 | 30 |
| 19) | OSi L77 (Me Terminal) | 9.7 | +97 | 8.6 | +132 | — | — |
| 20) | Mazer PPG SF19 (HO) | 6.4 | +31 | 7.8 | +111 | 80 | 1 |

There are two groups of results here. First is a group (Tests Nos: 6 to 13) where the reacted layer significantly improves both cyanoacrylate adhesion and corrosion resistance, and the second group (Tests Nos: 14 to 20) shows a clear trend for polyethylene glycol siloxanes to increase bond strength with both epoxy amine and cyanoacrylate adhesives, and also in most cases increases corrosion resistance. In each case the variation in bond strength shown is greater than any experimental error might be, so this result clearly demonstrates that a reacted siloxane layer radically affects surface adhesion.

The variations in adhesion between the siloxanes is mainly attributed to variation in pendant length and structure and to a much lesser extent the terminal molecule. There is evidence that the materials with OH-terminated caps on their pendants show more rust corrosion that those with Me. The Me would be hydrophobic, and this supports the idea that the pendant molecules are orientated away from the surface (as suggested hereinabove). It is reasonable to assume these caps are available to engage in further organic reactions without effecting the basic surface.

SF19 showed the lowest corrosion performance of these materials but because of its average adhesion performance it was chosen for further exploratory tests as follows.

Tests with SF19 and Permabond 246 (described as a "Toughened Acrylic" adhesive) showed an increase in bond strength of 25% average over a series of joints.

Tests with SF19 only on Loctite Anaerobic material (known only as "648") showed a 35% average increase in strength over a series of joints.

I claim:

1. An abrading tool which comprises:

a substrate on the surface of which, and optionally in the body of which, is carried an abrasive composition comprising an abrasive admixed with a rubbery siloxane composition which is the reaction product of a reactive polyfunctional siloxane co-polymerized with itself or with one or more other reactive polyfunctional siloxane to form a rubbery-solid material, this reaction product being admixed with a liquid siloxane which is stably dispersed therewithin.

2. A tool as claimed in claim 1, which is a grinding wheel, disc or belt.

3. A tool as claimed in claim 1, which is an abrasive-coated paper or non-woven cloth.

4. A tool as claimed in claim 3, wherein the abrasive is a mixture of a fine abrasive and a less fine abrasive.

5. A tool as claimed in claim 1, wherein the abrasive is alumina.

6. A tool as claimed in claim 1, wherein the rubbery siloxane composition is soft.

7. A tool as claimed in claim 1, wherein the rubbery composition is the cross-linked reaction product of a polyfunctional siloxane with either itself, with the assistance of a cross-linking agent, or with at least one other, different, polyfunctional siloxane, wherein each polyfunctional siloxane component contains at least three functional groups which may be the same or different, and the said reaction product has a loose three-dimensional matrix capable of holding the liquid silicone therewithin.

8. A tool as claimed in claim 7, wherein the polyfunctional siloxane is a silicone polymers made up of many units derived from moieties of the formula

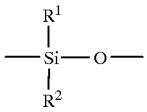

wherein each of $R^1$ and $R^2$ is a methyl group.

9. A tool as claimed in claim 7, wherein the reaction product is formed by the reaction of a polysiloxane having amino functionality and a polysiloxane having dicarboxylic-anhydride functionality.

10. A tool as claimed in claim 1, wherein the liquid siloxane is a diorganyl siloxane of the General Formula $$[—O—Si(R_2)—]$$

wherein each R group, which may be the same or different, is hydrogen or a hydrocarbyl or poly(oxyhydrocarbyl) group.

11. A tool as claimed in claim 10, wherein the siloxane is a friction-enhancer, and is a dimethyl or a hydrogenmethyl siloxane.

12. A tool as claimed in claim 10, wherein the siloxane is suitable for use in excoriating/conditioning, and is a poly (oxyethylene)siloxane.

13. A method of shaping an object in which the surface of the object is abraded away using a coarsely-abrasive tool as defined in claim 1.

14. A method of conditioning a metal part by providing it with a surface having bonded thereto a siloxane layer, which method includes the stages of first excoriating the part's surface under oxygen-excluding conditions and, optionally in the presence of a siloxane, to clean off any oxide film therefrom and to leave the metal surface bare and oxide-free, and then further rubbing the bare metal surface in the presence of a siloxane in a substantially non-abrasive manner to form on the clean surface said siloxane layer comprising siloxane molecules individually bonded directly to the surface.

15. A conditioning method as claimed in claim 14, in which the excoriation stage is effected using an abrading tool which comprises:

a substrate on the surface of which, and optionally in the body of which, is carried an abrasive composition comprising an abrasive admixed with a rubbery siloxane composition which is the reaction product of a reactive polyfunctional siloxane co-polymerized with itself or with one or more other reactive polyfunctional siloxanes to form a rubbery-solid material, this reaction product being admixed with a liquid siloxane which is stably dispersed therewithin.

16. A conditioning method as claimed in claim 14, in which, to protect the bare metal surface produced from ambient oxygen, the excoriation is effected using a rubbing, abrasive tool that completely covers a relatively large area at a time, and is moved to rub in circles or zigzags that are small in relation to the tool's surface area and that gradually translocate across the metal surface.

17. A conditioning method as claimed in claim 14, wherein the further rubbing of the thus-cleaned surface is a simple continuation of the first stage.

18. A metal part with a conditioned surface, the surface having siloxane molecules each individually bonded directly to the metal over a relatively large area of the surface to provide a relatively uniform siloxane layer.

19. A conditioning method as claimed in claim 14 in which the excoriation is effected with a tool using abrasive-loaded nylon filaments, a non-woven abrasive material, a coated abrasive belt, a flap wheel or a cloth buff.

20. A conditioning method as claimed in claim 14 in which the excoriation is effected with a tool using abrasive-loaded nylon filaments.

* * * * *